United States Patent [19]

Labelle

[11] Patent Number: 4,586,552

[45] Date of Patent: May 6, 1986

[54] ROLLING CLOSURE GUIDE MEANS

[75] Inventor: H. M. Robert Labelle, Cornwall, Canada

[73] Assignee: Martinray Industries Ltd., Cornwall, Canada

[21] Appl. No.: 573,672

[22] Filed: Jan. 25, 1984

[30] Foreign Application Priority Data

Jun. 10, 1983 [CA] Canada ..... 430165

[51] Int. Cl.[4] ..... E06B 9/34

[52] U.S. Cl. ..... 160/133; 160/264; 160/272; 49/485; 49/489

[58] Field of Search ..... 160/268 R–273 C, 160/264, 266, 208; 49/489, 490, 485

[56] References Cited

U.S. PATENT DOCUMENTS

| | | | |
|---|---|---|---|
| 137,595 | 4/1873 | Clark | 160/271 X |
| 3,292,685 | 12/1966 | Clark | 160/264 |
| 4,300,528 | 11/1981 | Slemmons | 49/485 |

FOREIGN PATENT DOCUMENTS

| | | | |
|---|---|---|---|
| 1465994 | 12/1966 | France | 160/272 |
| 1511113 | 12/1967 | France | 160/267 |

*Primary Examiner*—Ramon S. Britts
*Assistant Examiner*—Cherney S. Lieberman
*Attorney, Agent, or Firm*—Charles E. Brown; Charles A. Brown

[57] ABSTRACT

Rolling closure guide means. The guide means comprise two vertical guide members for use in guiding the edges of a rolling closure during opening or closing operations. Two guide strips are mounted on each guide member for guiding the edge of the closure between them. In one embodiment, the guide strips are manufactured in different thicknesses so that strips of the appropriate thickness, depending on the thickness of the closure, can be mounted on the guide members to guide the closure. In another embodiment, guide strips of only one thickness are used, along with one or more spacers if needed, to guide closures of different thickness in the guide members.

2 Claims, 11 Drawing Figures

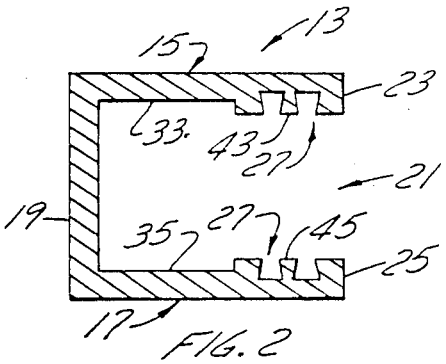
FIG. 2
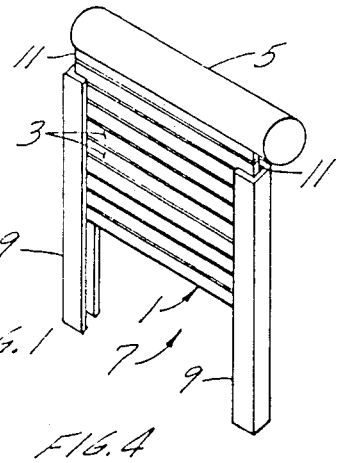
FIG. 1
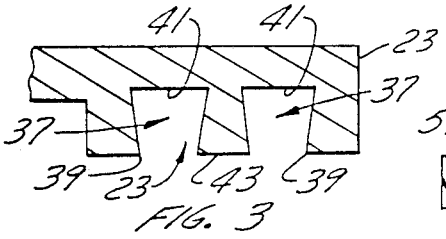
FIG. 3
FIG. 4
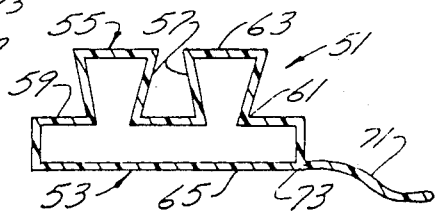
FIG. 5
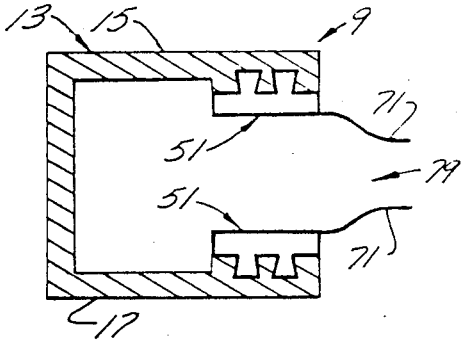
FIG. 6
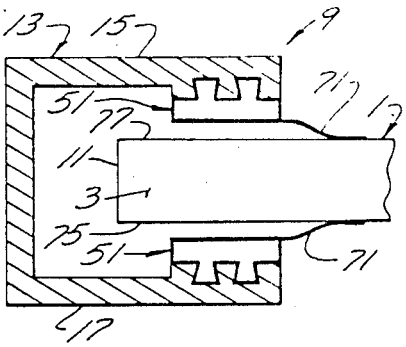
FIG. 7a
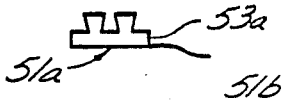
FIG. 7b
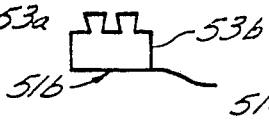
FIG. 7c
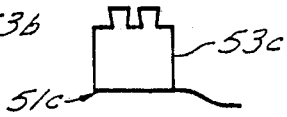

ROLLING CLOSURE GUIDE MEANS

BACKGROUND OF THE INVENTION

1. Field of the Invention

This invention is directed toward improvements in guide systems for closures, and more particularly for rolling closures.

2. Description of the Prior Art

Rolling closures comprise a plurality of sections or slats pivotally joined together. The closure is usually wound on a drum above an opening when not in use. When the closure is used to close the opening, it is unwound from the drum and moves down guided at its side edges by a guide system comprising vertical guide means at the sides of the opening. Each guide means includes a rigid, channel-shaped, guide member sized to receive a closure of one specific thickness between its arms. Thus, thicker closures require wider guide members and thinner closures require narrower guide members. Several sizes of guide members must therefore be provided in order to accomodate closures of different thickness and this is expensive.

SUMMARY OF THE INVENTION

It is the purpose of the present invention to provide a guide system for closures, and particularly for rolling closures, which is less expensive than the guide systems presently used. In accordance with the present invention, a guide system is provided with two guide members sized to receive the thickest closure between their arms. Each guide member can however, by easily and inexpensively adapted to guide thinner closures as well so that only one size of guide member is needed for all the closures.

Each guide member is provided with a guide strip on the inner side of each arm to smoothly guide the closure between the arms. Each guide strip has a guide surface on one side for guiding the closure. In accordance with the present invention, the guide system includes means permitting the distance between the guide surfaces on each guide member to be narrowed to accomodate closures of narrower thickness than the widest thickness the guide members can normally accomodate. In one embodiment of the present invention, the guide strips are provided in several thicknesses. Thus the proper thickness of guide strip can be selected so that the gap between the guide surfaces matches the thickness of the closure being guided. In another embodiment of the present invention, guide strips of only one thickness are provided, but one or more spacer members are provided for each guide member if needed. The spacer member can be selectively mounted between one guide strip and one arm on a guide member to narrow the gap between the guide surfaces and thus accomodate a thinner closure.

In either embodiment of the invention, the use of a single large size of guide member, together with the use of different thicknesses of guide strips, or the use of spacers, provides a relatively inexpensive way of changing the size of the gap between the closure guide surfaces, compared to the cost of providing different sizes of guide members in the guide systems presently employed.

The invention is particularly directed toward a guide system for a rolling closure having a pair of guide members with each guide member having a pair of opposing walls between which a side edge of a rolling closure is adapted to be guided. A guide strip is mounted on the inner side of each wall. Each guide strip has a guide surface on which the closure is guided. Means are provided permitting the distance between the guide surfaces on each guide member to be selectively changed to accomodate closures of different thickness.

In one embodiment, the means permitting the distance between the guide surfaces on each guide member to be changed comprises providing at least two different thicknesses of guide strips and selecting that thickness of guide strip which best matches the thickness of the closure to be guided.

In another embodiment, the means permitting the distance between the guide surfaces on each guide member to be changed comprises providing at least one spacer member adapted to be selectively mounted between a guide strip and a wall on each guide member.

BRIEF DESCRIPTION OF THE DRAWINGS

The invention will now be described in detail having reference to the accompanying drawings in which:

FIG. 1 is a perspective view of a rolling closure being guided during use;

FIG. 2 is a cross-section view of a guide member;

FIG. 3 is a detail cross-section view of a portion of the guide member;

FIG. 4 is a cross-section view of a guide strip;

FIG. 5 is a cross-section view of the guide means;

FIG. 6 is a cross-section view of the guide means guiding one edge of a closure;

FIGS. 7A, 7B and 7C are cross-section views of different sizes of guide strips;

DESCRIPTION OF THE PREFERRED EMBODIMENTS

Figure 9:
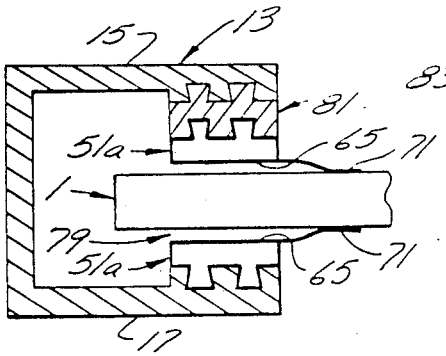
FIG. 9 is a cross-section view of the guide means guiding one edge of a closure using a spacer.

Folding closures 1, as shown in FIG. 1, comprise a plurality of slats 3 which are arranged side-by-side and which are pivotally connected together along adjacent sides. The closure 1 is wound on a horizontally-mounted drum (not shown) within a cylindrical housing 5 above an opening 7. A guide system for guiding the closure 1 includes guide means 9 mounted on the vertical sides of the opening 7. The closure 1 is normally rolled up within housing 5 above the opening 7 when not in use. When the opening 7 is to be closed, the closure 1 is unwound from within housing 5 and moves down to close the opening 7, being guided at its side edges 11 by the vertical guide means 9 on the sides of the opening.

Each guide means 9 includes a rigid, elongated guide member 13 having a pair of parallel, side walls 15, 17 as shown in FIG. 2. The side walls 15, 17 are joined together at one end by an end wall 19. The gap 21 between the other ends 23, 25 of the side walls 15, 17 provides entry for a side edge 11 of the closure 1 between the side walls. Mounting means 27 are provided on the guide member 13 for mounting guide strips thereto. The mounting means 27 preferably are provided on the inner surface 33, 35 of each side wall 15, 17 respectively, adjacent their free ends 23, 25, respectively. Each mounting means 27 as shown in FIG. 3 comprises at least one, and preferably two grooves 37 of the type having a narrow neck 39 and a wide base 41. The grooves 37 on the inner surface 33 of the side wall 15 open to, and are aligned with the grooves 37 on the inner surface 35 of the other side wall 17 as shown in FIG. 2. The portions 43, 45 of the side walls 15, 17 adjacent their free ends 23, 25 respectively can be thickened, as shown in FIG. 2 on their inner surfaces 33, 35 to accomodate the grooves 37. The guide member 13 is extruded in one single size, large enough to accomodate the thickest closure, with the grooves 37 formed therein.

Guide strips 51 are provided for use with the guide member 13. Each guide strip 51 includes a relatively rigid body portion 53 as shown in FIG. 4 with mounting means 55 on one side thereof. The mounting means 55 comprise a pair of parallel ribs 57 projecting from the inner side 59 of the body portion 53, each rib 57 having a narrow base 61 adjacent side 59 and a wide, free end 63. Each rib 57 has a cross-sectional profile matching the cross-sectional profile of a groove 37. One of the guide strips 51 is slidably mounted on the inner surface 33 of the side wall 15 of guide member 13 by sliding its ribs 57 into the matching grooves 37 from one end or the other of the guide member 13 as shown in FIG. 5. Another guide strip 51 is similarly slidably mounted on the inner surface 35 of side wall 17. The mounted guide strips 51 extend the length of the guide member 13 and present a smooth, outer guide surface 65 against which the closure 1 runs while guided by the guide means 9.

The guide strips 51 are extruded from suitable thermoplastic material which provides a low coefficiency of friction as the closure slides between the guide surfaces 65. Preferably, each strip 51 is also provided with a sealing flap 71 which extends outwardly and slightly inwardly from the outer, outside corner 73 of the body portions 53. The flap 71 is extruded integrally with the strip 51 but is made of softer, more flexible material. The flap 71 bears against the outer and inner surfaces 75, 77 of the closure 1 adjacent its side edges 11 as shown in FIG. 6. Normally, the gap 79 between the guide surfaces 65 of the guide strips 51 is noticeably wider than the width of the closure 1 so as to prevent binding. For this reason, the sealing flaps 71 are bowed inwardly to ensure sealing even if the closure is not touching all areas of the guide surfaces 65.

In accordance with one embodiment of the present invention, at least two or more different sizes of guide strips 51 are provided, differing from each other only in the thickness of the body portion 53. Thus, as shown in FIGS. 7A, 7B and 7C, three sizes of guide strips 51*a*, 51*b*, 51*c* can be provided any one of which can be slidably mounted on the guide member 13. The three sizes of guide strips 51*a*, 51*b*, 51*c* differ only in that the thickness of their body portions 53*a*, 53*b*, 53*c* is different from each other. Thus, the body portion 53*a* of strip 51*a* can be one-sixteenth of an inch thick; the body portion 53*b* of strip 51*b*, nine-sixteenths of an inch thick; and body portion 53*c* of strip 51*c*, one and one-sixteenth of an inch thick. As a result of having guide strips of three different thicknesses, the guide means 9 can be simply adapted to guide closures of different thickness. Thus, if a closure having a two inch thickness is to be guided, two of the thinnest guide strips 51*a* are used in the guide member 13. If a closure one inch thick is to be guided, the thickest guide strip 51*c* is used along with a thin guide strip 51*a* in the guide member. The front 75 of the closure 1, no matter what the thickness of the closure, is always preferably located adjacent the outside wall 17 of the guide member 13. For this reason the one thin guide strip 51*a* always used is mounted in the outside wall 17 of the guide member 13. This guide strip 51*a* can be permanently fixed in wall 17. The other guide strip 51 in the other wall 15 is of the required thickness to accomodate the thickness of the closure used and preferably is detachably mounted in wall 15 so it can be changed if the closure is changed to a different thickness.

It is thus seen that a guide member 13 of a single size can be readily adapted to guide and seal closures of varying thickness by merely selecting the appropriate sized guide strips 51 to be used with the guide member. The different sized guide strips 51 are much cheaper to manufacture than different sized guide members.

Figure 8:
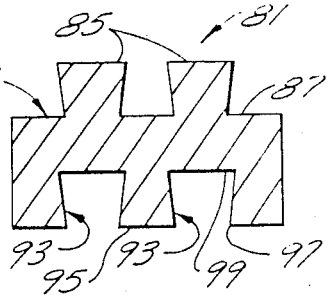
FIG. 8 is a cross-section view of a spacer.

In another embodiment of the present invention, one or more spacers 81 can be used with the thinnest guide strips 51*a* to narrow the gap 79 between the arms of the guide member 13. As shown in FIG. 8, each spacer 81 comprises an elongated body 83 having a pair of ribs 85 projecting from the inner side 87 of the body 83. Each rib 85 has a narrow base 89 adjacent the inner side 87 of the body 83 and a wide, free end 91. The ribs 85 have a cross-sectional profile matching the cross-sectional profile of the grooves 37 in the walls 15, 17 of the guide member 13. A pair of grooves 93 are provided in the outer side 95 of the body 83. Each groove 92 has a narrow neck 97 and a wide base 99. The grooves 93 match grooves 37 in the guide member 13.

If the guide member 13 is to guide a closure 1 having a narrower thickness than thickness of the closure guided by guide member 13 using two thin guide strips 51*a*, a spacer 81 is interposed between one of the guide strips 51*a* and the inner wall 15 of the guide member 13 as shown in FIG. 9. The spacer 81 narrows the gap 79 between the guide surfaces 65 on the guide strips 51*a* to guide the narrower closure. Two spacers 81, stacked one against the other, can be used to narrow the gap 79 even further if needed. The spacers 81 can be extruded from suitable metallic material such as aluminum.

I claim:

1. In a guide system for guiding one of two rolling closures of different thickness, the closures differing in thickness by an incremental thickness; the guide system having a minimum of at least four separate elements comprising: a guide member having a pair of opposing walls between which a side edge of a selected closure from the two closures is to be guided, and three guide strips for use with the guide member; the guide member having a size to accomodate the thickest closure, each guide strip having a guide surface for guiding a rolling closure and a mounting surface; co-operating structural means on the mounting surface of each guide strip and on the inner faces of the opposing walls of the guide member for detachably mounting each guide strip on either opposing wall with its mounting surface adjacent the inner face of the wall; at least two of the guide strips being of a different thickness, the difference in thickness equal to the incremental difference in thickness between the two closures; any two of the guide strips detachably mounted on the guide member at any one time with their guide surfaces facing each other to make the guide member operative, the two guide strips selected being of a thickness to accomodate the selected closure of the two closures of different thickness to be guided.

2. In a guide system for guiding one of two rolling closures of different thickness, the closures differing in thickness by an incremental thickness; the system having a minimum of at least four separate elements comprising: a guide member having a pair of opposing walls between which a side edge of a selected closure from the two closures is to be guided, two guide strips and one spacer strip for use with the guide member: and the guide member having a size to accomodate the thickest closure: each guide strip having a guiding surface and a mounting surface, the spacer strip having a first mounting surface and a second mounting surface; co-operating structural means on the mounting surfaces of the guide and spacer strips, and on the inner faces of the walls of the guide member so that the spacer strip can be detachably mounted to one of the walls and so that the guide strips can each be detachably mounted to a wall or to the spacer strip, the spacer strip having a thickness equal to the incremental difference in thickness between the closures; the two guide strips mounted on the guide member with their mounting surfaces so as to have their guide surfaces facing each other to make the guide member operative, at least one of the guide strips selectively mounted directly on the guide member, or indirectly on the guide member via the spacer strip so as to have the distance between the guide surfaces on the guide strips fit the thickness of the selected closure of the two closures of different thickness to be guided.

* * * * *